US011282416B2

(12) United States Patent
Huang et al.

(10) Patent No.: US 11,282,416 B2
(45) Date of Patent: Mar. 22, 2022

(54) FLEXIBLE DISPLAY DEVICE AND METHOD FOR OPERATING THE SAME

(71) Applicant: EverDisplay Optronics (Shanghai) Co., Ltd., Shanghai (CN)

(72) Inventors: Huanyu Huang, Shanghai (CN); Jr-Hong Chen, Shanghai (CN); Chengpei Huang, Shanghai (CN)

(73) Assignee: Everdisplay Optronics (Shanghai) Co., Ltd, Shanghai (CN)

( * ) Notice: Subject to any disclaimer, the term of this patent is extended or adjusted under 35 U.S.C. 154(b) by 0 days.

(21) Appl. No.: 16/787,235

(22) Filed: Feb. 11, 2020

(65) Prior Publication Data

US 2020/0265758 A1 Aug. 20, 2020

(30) Foreign Application Priority Data

Feb. 15, 2019 (CN) ..... 201910117681.2
Feb. 15, 2019 (CN) ..... 201920205068.1

(51) Int. Cl.
*G09F 9/30* (2006.01)

(52) U.S. Cl.
CPC ..... *G09F 9/301* (2013.01)

(58) Field of Classification Search
CPC ..... G09F 9/30; G09F 9/301; G09G 3/3266; G09G 3/3275; G02F 1/13452; H01L 27/124; H01L 27/3276; H05K 2201/10128
See application file for complete search history.

(56) References Cited

U.S. PATENT DOCUMENTS

| | | | | |
|---|---|---|---|---|
| 9,356,087 | B1 * | 5/2016 | Lee | H01L 27/3209 |
| 9,871,217 | B1 * | 1/2018 | Lin | H01L 51/5234 |
| 11,054,683 | B2 * | 7/2021 | Yin | G02B 1/14 |
| 2011/0134145 | A1 * | 6/2011 | Moriwaki | G09G 3/035 345/660 |
| 2013/0107142 | A1 * | 5/2013 | Shirasaka | H05K 5/02 348/843 |
| 2016/0103649 | A1 * | 4/2016 | Yoshitani | G09G 3/2003 345/694 |
| 2017/0062760 | A1 * | 3/2017 | Kim | H01L 27/3276 |
| 2017/0373121 | A1 * | 12/2017 | Leng | H01L 27/3244 |
| 2019/0317609 | A1 * | 10/2019 | Zhang | G06F 3/0487 |
| 2020/0043381 | A1 * | 2/2020 | Tsukamoto | H01L 51/003 |
| 2020/0047475 | A1 * | 2/2020 | Gao | H01L 51/56 |
| 2020/0052231 | A1 * | 2/2020 | Nakamura | H01L 51/0097 |
| 2020/0184858 | A1 * | 6/2020 | Kishimoto | G09F 9/301 |
| 2020/0227682 | A1 * | 7/2020 | Ohara | H01L 51/5281 |
| 2020/0281080 | A1 * | 9/2020 | Cheng | H05K 1/18 |
| 2021/0068270 | A1 * | 3/2021 | Zhou | G06F 1/1681 |
| 2021/0112651 | A1 * | 4/2021 | Lee | A61L 9/22 |
| 2021/0141415 | A1 * | 5/2021 | Gu | G02B 1/14 |
| 2021/0200267 | A1 * | 7/2021 | Sutherland | G09F 9/00 |

FOREIGN PATENT DOCUMENTS

CN 104103582 A * 10/2014 ..... H01L 51/0011

* cited by examiner

*Primary Examiner* — Joe H Cheng
(74) *Attorney, Agent, or Firm* — Qinghong Xu

(57) ABSTRACT

A flexible display device includes a flexible display panel and an adsorption layer including at least one rigid plane and the flexible display panel is adsorbed on the rigid plane to maintain flatness of the flexible display plane.

8 Claims, 5 Drawing Sheets

FLEXIBLE DISPLAY DEVICE AND METHOD FOR OPERATING THE SAME

CROSS-REFERENCE TO RELATED APPLICATIONS

This application is based upon and claims priority to Chinese Patent Application 20191.0117681.2, filed on Feb. 15, 2019 and Chinese Patent Application 201920205068.1, filed on Feb. 15, 2019, the entire contents of which are incorporated herein by reference.

TECHNICAL FIELD

The present disclosure generally relates to the field of display technology, and more particularly, to a flexible display device and an operating method thereof.

BACKGROUND

Flexible display devices are display devices made of flexible materials that can be bent and deformed. Due to their outstanding display characteristics, such as flexibility and lightness, flexible display devices can be applied to various fields, such as wearable devices, mobile devices, augmented reality and virtual reality. This technical equipment, the flexible display devices, is considered to be the mainstream of the future display field. Generally, the flexible display device can be folded or scrolled in a non-display state, and expanded when in a display state.

However, the existing flexible display devices are susceptible to damage during the folding/scrolling process, and irreversible deformation also occurs after long-term folding/scrolling storage. The problems such as creasing or warping are caused after the flexible display device is unfolded. The display effect of the flexible display device is then affected.

SUMMARY

In one embodiment of the present disclosure, a flexible display device includes a flexible display panel and an adsorption layer including at least one rigid plane. The flexible display panel is adsorbed on the rigid plane to maintain flatness of the flexible display panel.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments consistent with the invention and, together with the description, serve to explain the principles of the invention.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the invention. Instead, they are merely examples of apparatuses and methods consistent with aspects related to the invention as recited in the appended claims.

First Embodiment

Figure 1:
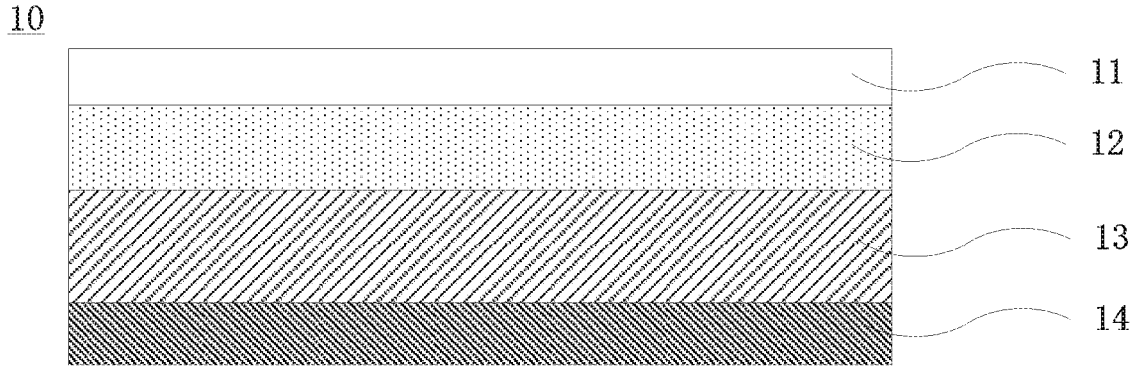
FIG. 1 shows a schematic view of the structure of a flexible display device, according to a first exemplary embodiment.

Referring to FIG. 1, FIG. 1 shows a schematic view of the structure of a flexible display device 10, according to a first exemplary embodiment. As shown in FIG. 1, the flexible display device 10 includes a flexible display panel 11 and an adsorption layer 12. The adsorption layer 12 is used to adsorb the flexible display panel 11. The adsorption layer 12 includes at least one rigid plane and the flexible display panel 11 is adsorbed on the rigid plane to maintain flatness of the flexible display panel 11.

In some embodiments, the flexible display panel 11 includes any one of the current flexible display panels which include flexible organic light-emitting displays, flexible liquid crystal displays and flexible electrophoretic displays and will not be limited therein. A substrate of the flexible display panel 11 is made of flexible materials and is bendable. The flexible materials include polyimide, polyethylene naphthalate, polyethylene terephthalate, metal film or other bendable materials.

The adsorption layer 12 includes at least one adsorption unit which is used to adsorb the flexible display panel 11. Moreover, at least one plane of the adsorption layer 12 is a rigid plane leaned on the flexible display panel 11 and has physical hardness higher than the flexible display panel. The flexible display panel 11 is firmly adsorbed, via adsorption force, on the rigid plane of the adsorption layer 12 and the flexible display panel 11 is then presented as a plane state to avoid creasing or warping.

In this embodiment, the adsorption layer 12 is formed in one piece, which means a portion of the adsorption layer 12 and the rigid plane are made of the same material and have the same physical and chemical property. The materials of the rigid plane are selected based on the actual requirements and the materials of the rigid plane include plastic, ceramic, and metal. In other embodiments, the material of the rest portion of the adsorption layer 12 and the material of the rigid plane are different, which are able to be respectively made before combination.

In this embodiment, the adsorption layer 12 is present as a rectangular flatbed. In some embodiments, the adsorption layer 12 can be configured into other shapes, such as triangular, arched and wavy, as long as the adsorption layer 12 has a flat plane on which the flexible display panel 11 can be firmly adsorbed and maintained flatness.

Figure 2:
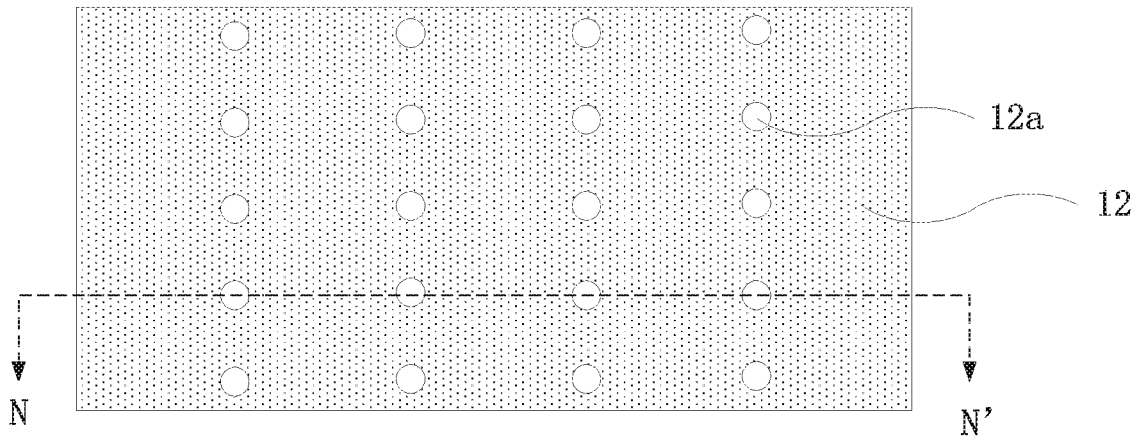
FIG. 2 shows a top view of an adsorption layer of the flexible display device of FIG. 1, according to the first exemplary embodiment.
Figure 3:
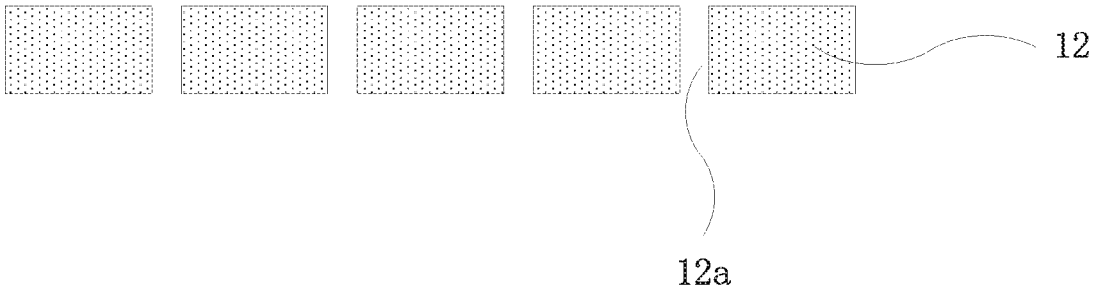
FIG. 3 shows a cross sectional view of the adsorption layer of FIG. 2 along line N-N'.

In this embodiment, the flexible display panel 11 is vacuum adsorbed on the rigid plane of the adsorption layer 12. Referring to FIGS. 2 and 3, FIG. 2 shows a top view of an adsorption layer of the flexible display device of FIG. 1, according to a first exemplary embodiment. FIG. 3 shows a cross sectional view of the adsorption layer of FIG. 2 along a line N-N'. As shown in FIGS. 2 and 3, the adsorption layer 12 includes at least one adsorption through-hole 12*a* as an adsorption unit conducted to an external vacuum device (not shown). When the adsorption through hole 12*a* is at a vacuum state, an adsorption force for adsorbing the flexible display panel 11 is then created and the flexible display panel 11 is adsorbed on the adsorption layer 12.

The number, size, shape and distribution of the adsorption through hole 12*a* are not limited herein. The cross-sectional shape of the adsorption through hole 12*a* is a circle, a triangle, a rectangle, a diamond, a pentagon, or an oval. In some embodiments, the cross-sectional shape of the adsorption through hole 12*a* is an irregular shape. For example, the adsorption through holes 12*a*, located at the adsorption layer 12, is a circle structure and the adsorption through holes 12*a*, located at the edge of the adsorption layer 12, is an oval structure. The size of each of the adsorption through holes 12*a* can be the same or not.

For example, the size of the adsorption through hole 12*a*, corresponding to a bending region of the flexible display panel 11, is larger. The size of the adsorption through hole 12*a*, deviated from the bending area, of the flexible display panel 11 is smaller. The adsorption through holes 12*a* are arranged in vertical and horizontal array, crisscross, parallel, Pozidriv or circle. Those skilled in the art can set the shape, size, number, and arrangement of the adsorption through holes 12*a* according to actual needs as long as the setting is good for adsorbing the corresponding flexible display panel 11. The flexible display panel 11 is then kept flat when in the flexible display panel 11 is in the adsorption state.

Figure 4:
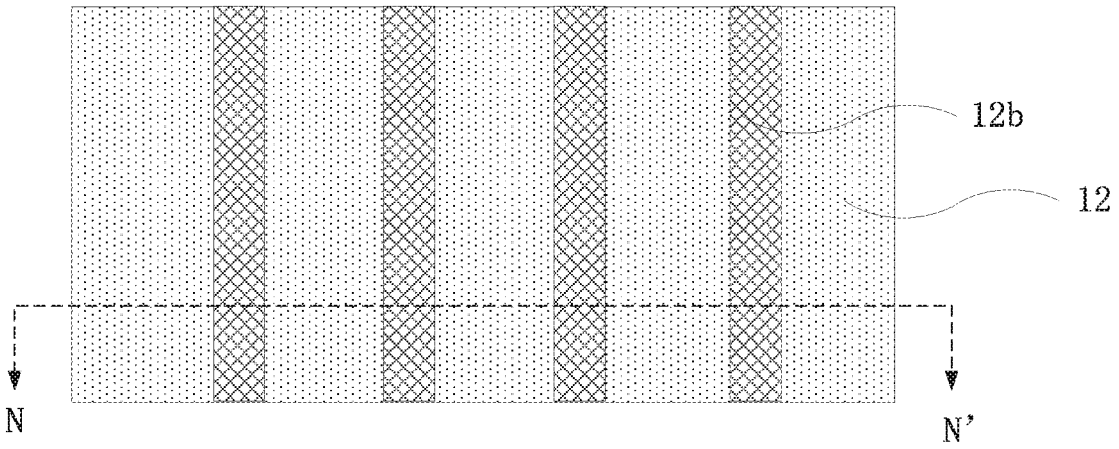
FIG. 4 shows a top view of an adsorption layer of the flexible display device, according to some other exemplary embodiments.
Figure 5:
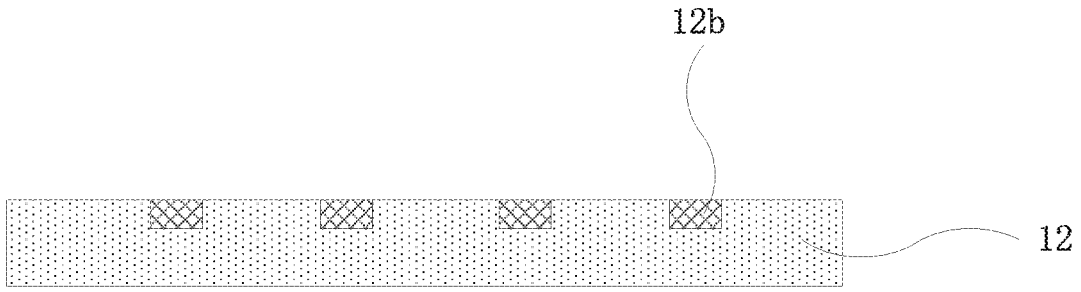
FIG. 5 shows a cross sectional view of the adsorption layer of FIG. 4 along a line N-N'.

In some other embodiments of the present disclosure, the flexible display panel 11 is adsorbed, by magnetic adsorption, on the rigid plane of the adsorption layer 12. Referring to FIGS. 4 and 5, FIGS. 4 and 5 show a schematic view of an adsorption layer of other embodiments of the present disclosure. As shown in FIGS. 4 and 5, the adsorption layer 12 includes at least one magnetic element 12*b* as a magnetic unit for creating a magnetic force. The flexible display panel 11 is then adsorbed on the adsorption layer 12. When the flexible display panel 11 is at a flat state, the flexible display panel 11 is adsorbed on the rigid plane of the adsorption layer 12, the flatness of the flexible display panel 11 is then maintained. When the flexible display panel 11 is betided, the flexible display panel 11 and the adsorption layer 12 are separated due to the releasing operation of the adsorption function and the flexible display panel 11 is then bendable. Referring to FIGS. 4 and 5, the cross-sectional shape of the magnetic element 12*b* is a rectangle. The magnetic elements 12*b* are arranged in parallel.

The number, size, shape and distribution of the magnetic element 12*b* are not limited herein. The cross-sectional shape of the magnetic element 12*b* is a circle, a triangle, a rectangle, a diamond, a pentagon, or an oval. In some embodiments, the cross-sectional shape of the magnetic element 12*b* is an irregular shape. For example, the magnetic element 12*b*, located at the central area of the adsorption layer 12, is a rectangle structure and the magnetic element 12*b*, located at the edge of the adsorption layer 12, is a square structure. The size of each of the magnetic element 12*b* is the same. In some embodiments, the size of each of the magnetic element 12*b* is not the same.

For example, the size of the magnetic element 12*b*, corresponding to a bending region of the flexible display panel 11, is larger. The size of the magnetic element 12*b*, deviated from the bending area, of the flexible display panel 11 is smaller. The arrangement of the magnetic element 12*b* is a vertical and horizontal arrangement. In some embodiments, the arrangement of the magnetic element 12*b* is crisscross. In some embodiments, the arrangement of the magnetic element 12*b* is in parallel. In some embodiments, the arrangement of the magnetic element 12*b* is a Pozidriv. In some embodiments, the arrangement of the magnetic element 12*b* is a circle. Those skilled in the art can set the shape, size, number, and arrangement of the magnetic element 12*b* according to actual needs as long as the setting is good for adsorbing the corresponding flexible display panel 11. The flexible display panel 11 is then kept flat when in the flexible display panel 11 is in the adsorption state.

In some embodiments of the present disclosure, the flexible display panel 11 is adsorbed, by electrostatic adsorption, on the rigid plane of the adsorption layer 12. The adsorption layer 12 includes at least one electrostatic adsorbing element (not shown). The electrostatic adsorbing element is coupled to a static generator (not shown). The arrangement of the electrostatic adsorbing elements is similar to the arrangement of the magnetic elements 12*b* and will not be repeated herein.

During the electrostatic adsorption operations, a direct current (DC) voltage, generated by the static generator, is applied on the electrostatic adsorbing element and the charges are gathered on the surface of the electrostatic adsorbing element to generate electrostatic force. Therefore, the flexible display panel 11 is adsorbed, by electrostatic force, on the rigid plane of the adsorption layer 12. When the flexible display panel 11 needs to be bended, a current is applied on the electrostatic adsorbing element for releasing the electrostatic force and the flexible display panel 11 is separated from the adsorption layer 12. The flexible display panel 11 is then bendable.

In some embodiments of the present disclosure, the flexible display panel 11 is adsorbed, by nano sucker, on the rigid plane of the adsorption layer 12. The rigid plane of the adsorption layer 12 includes a plurality of nano suckers. An adsorption force is created, when the nano sucker is pressed. The nano sucker then adsorbs on any kind of smooth surface. The arrangements of the nano suckers are not limited herein, which include rectangular arrays, circle arrays and oval arrays. During the adsorbing operations, the flexible display panel 11 is adsorbed via the nano suckers when the nano sucker is pressed. Therefore, the flexible display panel 11 is firmly adsorbed on the adsorption layer 12.

Referring to FIG. 1, the flexible display device 10 further includes a frame 13 and a bottom housing 14. A bottom supporter is formed by the frame and the bottom housing. The bottom supporter is used to receive the flexible display panel 11. The frame 13 is disposed on a side close to the flexible display panel 11 and the bottom housing 14 disposed on a side away from the flexible display panel 11. The flexible display panel 11 is disposed on the frame 13 and the bottom supporter is used to protect and support the flexible display panel 11. The adsorption layer 12 is disposed between the frame 13 of the bottom supporter and the flexible display panel 11. In some embodiments, the adsorption layer 12 and the frame are formed in one piece. In some embodiments, the adsorption layer 12 and the frame are respectively made and combined together.

In other embodiments of the present disclosure, the adsorption layer 12 adopts other adsorption ways which are not limited herein. As long as the flexible display panel 11 can be kept flat in the adsorption state and the flexible display panel 11 is bendable in the releasing state.

Furthermore, a method for operating the flexible display device is provided. The method for operating the flexible display device includes steps of adsorbing, by the adsorbing layer 12, the flexible display panel 11 to maintain a flatness of the flexible display panel 11 and dis-adsorbing flexible display panel 11 when the flexible display panel 11 is bent.

During the adsorption operation, the rigid plane of the adsorption layer 12 is continuously maintained as a flat plane such that the flatness of the flexible display panel 11 is maintained when the flexible display panel 11 is adsorbed on the adsorption layer 12. The flexible display panel 11 is kept as a flat panel without creasing or warping even the flexible display panel 11 is folded/scrolled in long time. When the flexible display panel 11 needs to be bended, the flexible display panel 11 is separated from the adsorption layer 12. The flexible display panel 11 is then bendable.

Second Embodiment

Figure 6:
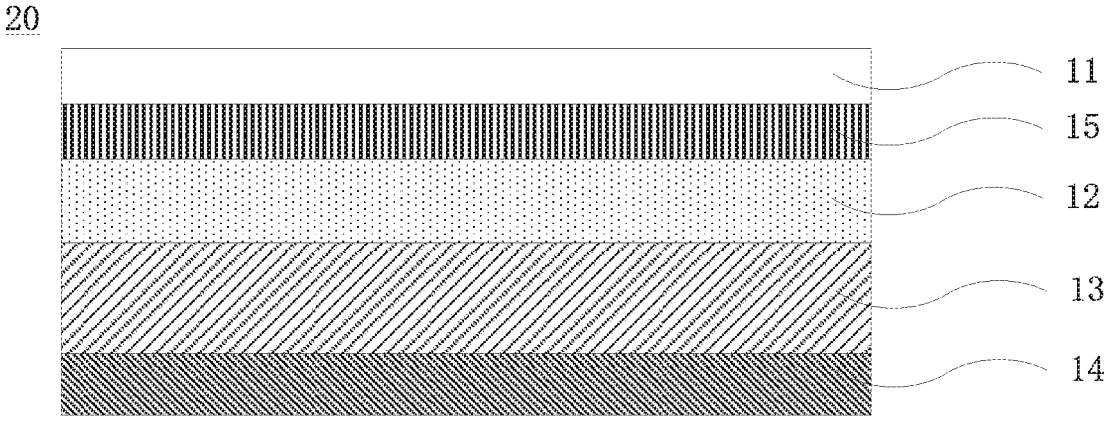
FIG. 6 shows a schematic view of the structure of a flexible display device, according to a second exemplary embodiment.

Referring to FIG. 6, FIG. 6 shows a schematic view of the structure of a flexible display device, according to a second exemplary embodiment. As shown in FIG. 6, a flexible display device 20 includes a flexible display panel 11 and an adsorption layer 12. The adsorption layer 12 is used to adsorb the flexible display panel 11. The adsorption layer 12 includes at least one rigid plane and the flexible display panel 11 is adsorbed on the rigid plane to maintain flatness of the flexible display panel 11.

Moreover, the flexible display panel 11 is adsorbed on the adsorption layer 12 by electrostatic adsorption, magnetic adsorption, vacuum adsorption or nano suckers, which allow the flexible display panel 11 firmly adsorbed on the rigid plane of the adsorption layer 12.

Referring to FIG. 6, the flexible display device 10 further includes a functional layer 15 disposed between the flexible display panel 11 and the adsorption layer 12. The functional layer 15 is coupled to the flexible display panel 11.

Figure 7:
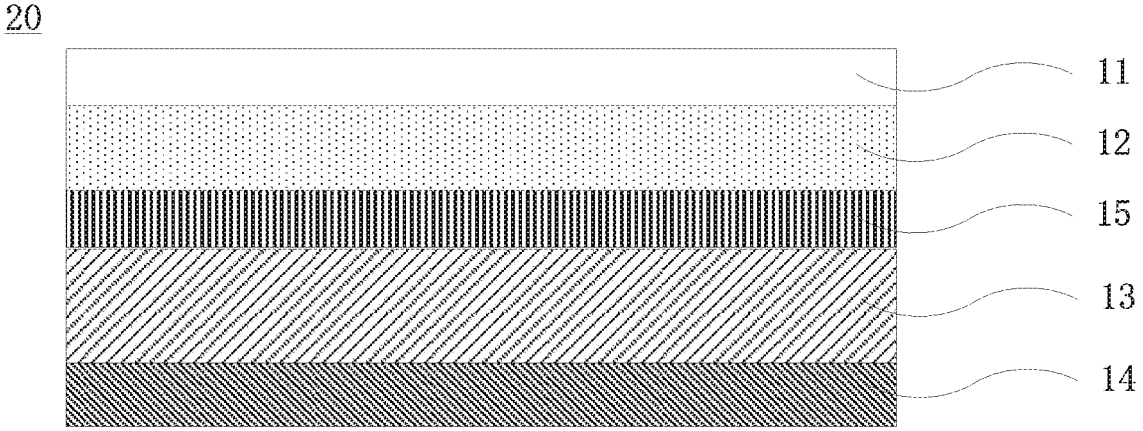
FIG. 7 shows a schematic view of the structure of a flexible display device, according to another exemplary embodiment.
Figure 8:
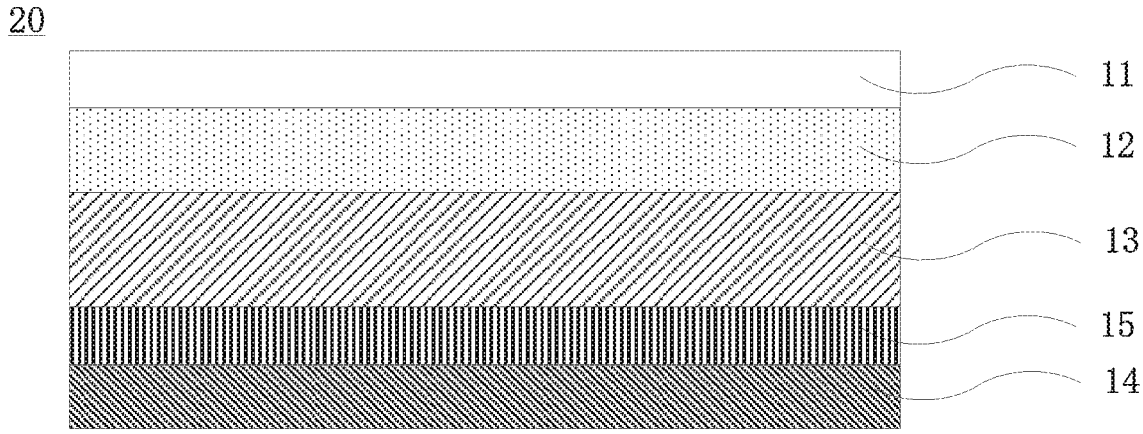
FIG. 8 shows a schematic view of the structure of a flexible display device, according to another exemplary embodiment.

In some other embodiments of the present disclosure, the functional layer 15 is disposed according to the actual need. Referring to FIG. 7, FIG. 7 shows a schematic view of the structure of a flexible display device, according to another exemplary embodiment. As shown in FIG. 7, the functional layer 15 disposed between the adsorption layer 12 and the frame 13 of the bottom supporter. Referring to FIG. 8, FIG. 8 shows a schematic view of the structure of a flexible display device, according to another exemplary embodiment. As shown in FIG. 8, the functional layer 15 is disposed between the bottom housing 14 and the frame 13 of the bottom supporter.

The second embodiment is similar to the first embodiment but the flexible display panel 20 further includes the functional layer 15. The functional layer 15 is disposed between the flexible display panel 11 and the adsorption layer 12. In some embodiments, the functional layer 15 is disposed between the adsorption layer 12 and the bottom supporter. In some other embodiments, the functional layer 15 is disposed between the bottom housing 14 and the frame 13 of the bottom supporter. The functional layer 15 includes any kind of functional layer designed according to requirements of the product design, which includes any one or combinations of a touch layer, a polarizer, a planarization layer, a heat dissipation layer, a buffer layer, and a protective layer.

Third Embodiment

Figure 9:
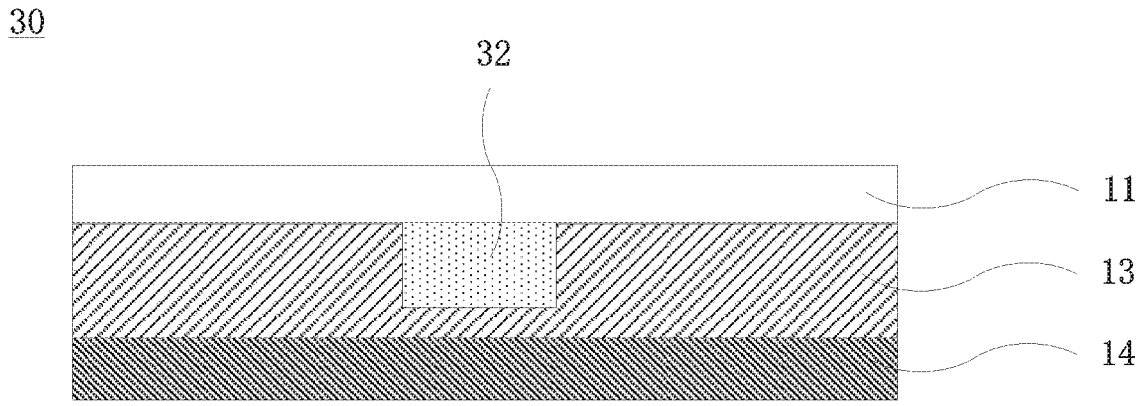
FIG. 9 shows a schematic view of the structure of a flexible display device, according to a third exemplary embodiment.

Referring to FIG. 9, FIG. 9 shows a schematic view of the structure of a flexible display device, according to a third exemplary embodiment. As shown in FIG. 9, a flexible display device 30 includes a flexible display panel 11 and an adsorption layer 32. The adsorption layer 32 is used to adsorb the flexible display panel 11. The adsorption layer 32 includes at least one rigid plane and the flexible display panel 11 is adsorbed on the rigid plane to maintain flatness of the flexible display panel 11.

Moreover, the flexible display panel 11 is adsorbed on the adsorption layer 32 by electrostatic adsorption, magnetic adsorption, vacuum adsorption or nano suckers, which allow the flexible display panel 11 is firmly adsorbed on the rigid plane of the adsorption layer 32.

Referring to FIG. 9, the flexible display device 10 further includes the frame 13 and the bottom housing 14. The frame 13 includes at least one groove for receiving the adsorption layer 32. The third embodiment is similar to the first embodiment but the adsorption layer 32 of the third embodiment is disposed corresponding to a bending region of the flexible display panel 11.

In summary, the flexible display device and an operating method thereof provided by the present disclosure discloses the adsorption and release of the flexible display panel by providing an adsorption layer on one side of the flexible display panel, and thereby the flexible display panel is able to avoid creases or warping, which improves the display quality of the flexible display device.

The above drawings merely schematically show the flexible display device provided by the present invention. For the sake of clarity, the shape and number of components in the above figures are simplified, and some components are omitted. Those skilled in the art can make changes according to actual requirements. These changes are all within the protection scope of the present invention, and will not be repeated here.

Other embodiments of the invention will be apparent to those skilled in the art from consideration of the specification and practice of the invention disclosed here. This application is intended to cover any variations, uses, or adaptations of the invention following the general principles thereof and including such departures from the present disclosure as conic within known or customary practice in the art. It is intended that the specification and examples be considered as exemplary only, with a true scope and spirit of the invention being indicated by the following claims.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. A flexible display device, comprising:

a flexible display panel; and an adsorption layer including at least one rigid plane and the flexible display panel is adsorbed on the rigid plane to maintain flatness of the flexible display panel;

the flexible display device further comprising a frame and a bottom housing, wherein a bottom supporter, used to receive the flexible display panel, is formed by the frame and the bottom housing;

the frame includes a groove for receiving the adsorption layer.

2. The flexible display device of claim 1, wherein the flexible display panel is adsorbed on the rigid plane with at least one way of electrostatic adsorption, magnetic adsorption and vacuum adsorption.

3. The flexible display device of claim 1, wherein a portion of a plane of the flexible display device or a full plane of the flexible display device is adsorbed on the rigid plane.

4. The flexible display device of claim 3, wherein the adsorption layer is in a planar shape and is integrally formed.

5. The flexible display device of claim 1, wherein the adsorption layer is disposed between the flexible display panel and the frame.

6. The flexible display device of claim 5, wherein the adsorption layer and the frame are formed in one piece.

7. The flexible display device of claim 1, wherein the adsorption layer and the frame are formed in one piece.

8. The flexible display device of claim 1 further comprising a function layer disposed between any two of the flexible display panel, the adsorption layer, the frame and the bottom housing.

* * * * *